US006378731B1

(12) United States Patent
Klabes

(10) Patent No.: US 6,378,731 B1
(45) Date of Patent: Apr. 30, 2002

(54) POURING SPOUT FOR A BAG

(76) Inventor: Alfons Klabes, Am Lullberg 5, D-34434, Borgholz (DE)

( * ) Notice: Subject to any disclaimer, the term of this patent is extended or adjusted under 35 U.S.C. 154(b) by 0 days.

(21) Appl. No.: 09/701,744

(22) PCT Filed: May 31, 1999

(86) PCT No.: PCT/EP99/03760

§ 371 Date: Mar. 1, 2001

§ 102(e) Date: Mar. 1, 2001

(87) PCT Pub. No.: WO99/62787

PCT Pub. Date: Dec. 9, 1999

(30) Foreign Application Priority Data

Jun. 3, 1998 (DE) ..... 198 24 738

(51) Int. Cl.[7] ..... B65D 5/72
(52) U.S. Cl. ..... 222/92; 222/567
(58) Field of Search ..... 222/107, 92, 567

(56) References Cited

U.S. PATENT DOCUMENTS 3,178,063 A 4/1965 Cox, Jr.
6,142,341 A * 11/2000 Uematsu ..... 222/92
6,273,307 B1 * 8/2001 Gross et al. ..... 222/92

FOREIGN PATENT DOCUMENTS

DE 43 10 673 A 10/1994

OTHER PUBLICATIONS

Patent Abstracts of Japan, Publication No. 05124657, Pub. Date May 21, 1993, Appln. 03248008, Horibe Fumio.

Patent Abstracts of Japan, Publication No. 09002495, Pub. Date Jan. 7, 1997, Appln. 07159635, Watabe Kenji.

* cited by examiner

*Primary Examiner*—Philippe Derakshani
(74) *Attorney, Agent, or Firm*—Browdy and Neimark, P.L.L.C.

(57) ABSTRACT

The invention relates to a pouring spout for a bag which comprises a spout (10) and which is inserted into a bag opening (2). Said spout (10) is detachably held in the bag opening (2) by clamping means (20, 30) such that it is sealed opposite the bag wall (3).

8 Claims, 5 Drawing Sheets

POURING SPOUT FOR A BAG

Figure 1:
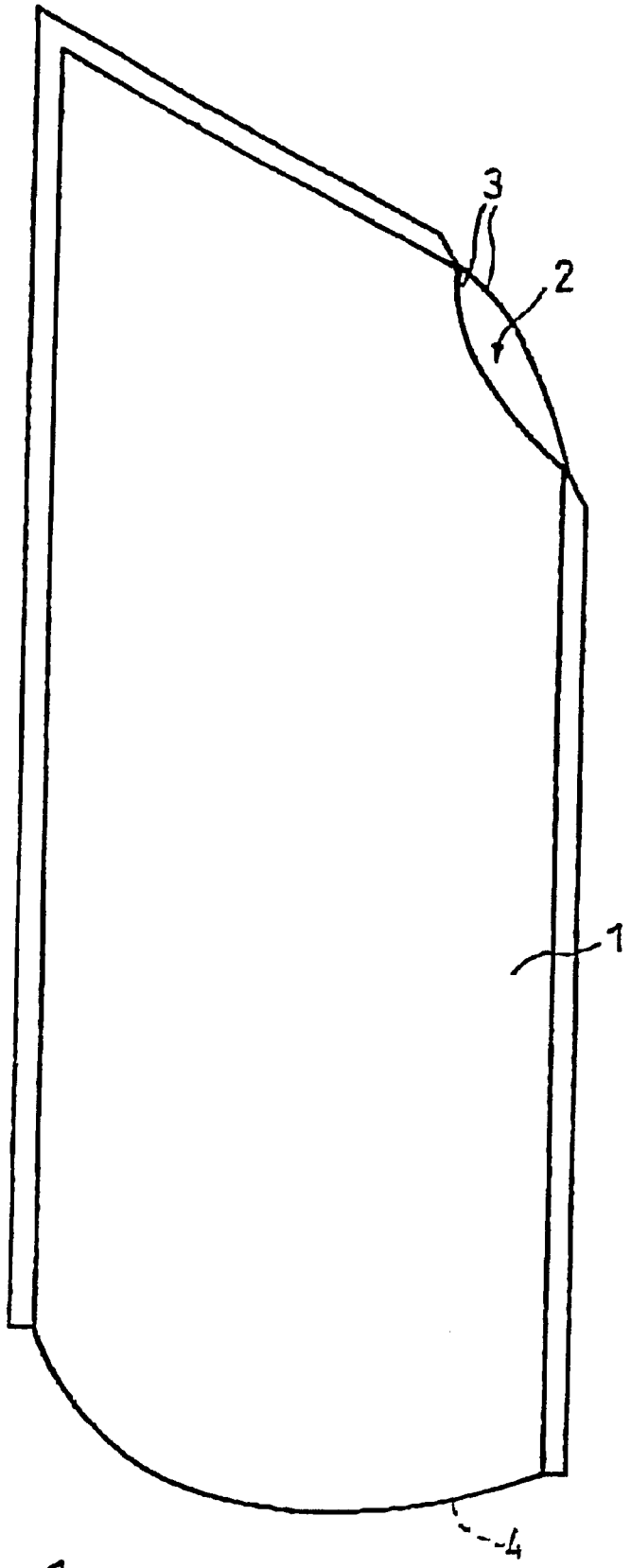

The invention relates to a pouring spout for bags having a spout inserted into a bag opening.

Bag pouring spouts of this type are known in practice. The spouts are generally inserted into a bag opening where they are heat sealed or glued to the bag. This entails a relatively complex and expensive manufacturing process on one hand. On the other hand, the pouring spout, which, in contrast to the flexible bag, is generally manufactured of a thicker, more stable material, is not reusable.

It is the object of the present invention to create a cost-effective and environmentally friendly alternative to this known prior art.

This object is met in such a way that the pouring spout has clamping means that detachably hold the spout inside the bag opening such that it is sealed relative to the bag wall.

The spout that is inserted into and held on the bag in this manner is removable from the bag and reusable after the bag has been emptied.

The bag opening in the bag can be created simply by cutting off a bag corner diagonally. In this case the bag itself may be manufactured particularly cost-effectively simply from a straight tubular material. However, it is also possible, of course, for the bag to have an integral projection, which is cut off straight and into which the spout is inserted.

The clamping means is preferably a clip that encompasses the spout on both sides in a collar-band-like manner and holds the bag wall surrounding the spout clamped in relative to the spout.

In a preferred embodiment, the clip is formed clasp-like with two legs that are connected to each other on one end by means of a hinge, e.g., a film or material hinge, and which both have snap-in means on their other ends, such as snap-in noses or snap-in hooks that cooperate with the respective other leg.

Alternately, the clip may also be formed as a two-part collar band with two collar band halves that each have snap-in means on both ends that cooperate with corresponding snap-in means on the ends of the respective other half of the collar band.

The legs or collar band halves of the clip have, on their opposed insides, a clamping channel so that an opening is formed between the joined legs or collar band halves, in which the spout is held in a form-fitting manner. To provide for the best possible support for the spout between the legs or collar band halves and to attain a good seal of the bag walls relative to the spout, the insides of the legs or collar band halves of the clip and the outside walls of the spout each have grooves and/or tongues that cooperate with each other. The grooves and/or tongues preferably extend in the longitudinal direction of the legs or collar band halves so that the bag wall is clamped in between the groove and tongue along the entire length of the bag opening.

The spout and the clip or clip elements may be connected to one another by means of flexible webs. The spout preferably also has a closing means, e.g., a stopper, which is also connected to the spout by means of a flexible web. All elements that are connected via the flexible webs may be advantageously cost-effectively manufactured from plastic in one process step. Since all parts are interconnected it is not possible to misplace individual parts, so that the entire spout is always complete without having to search for the pieces.

Figure 2:
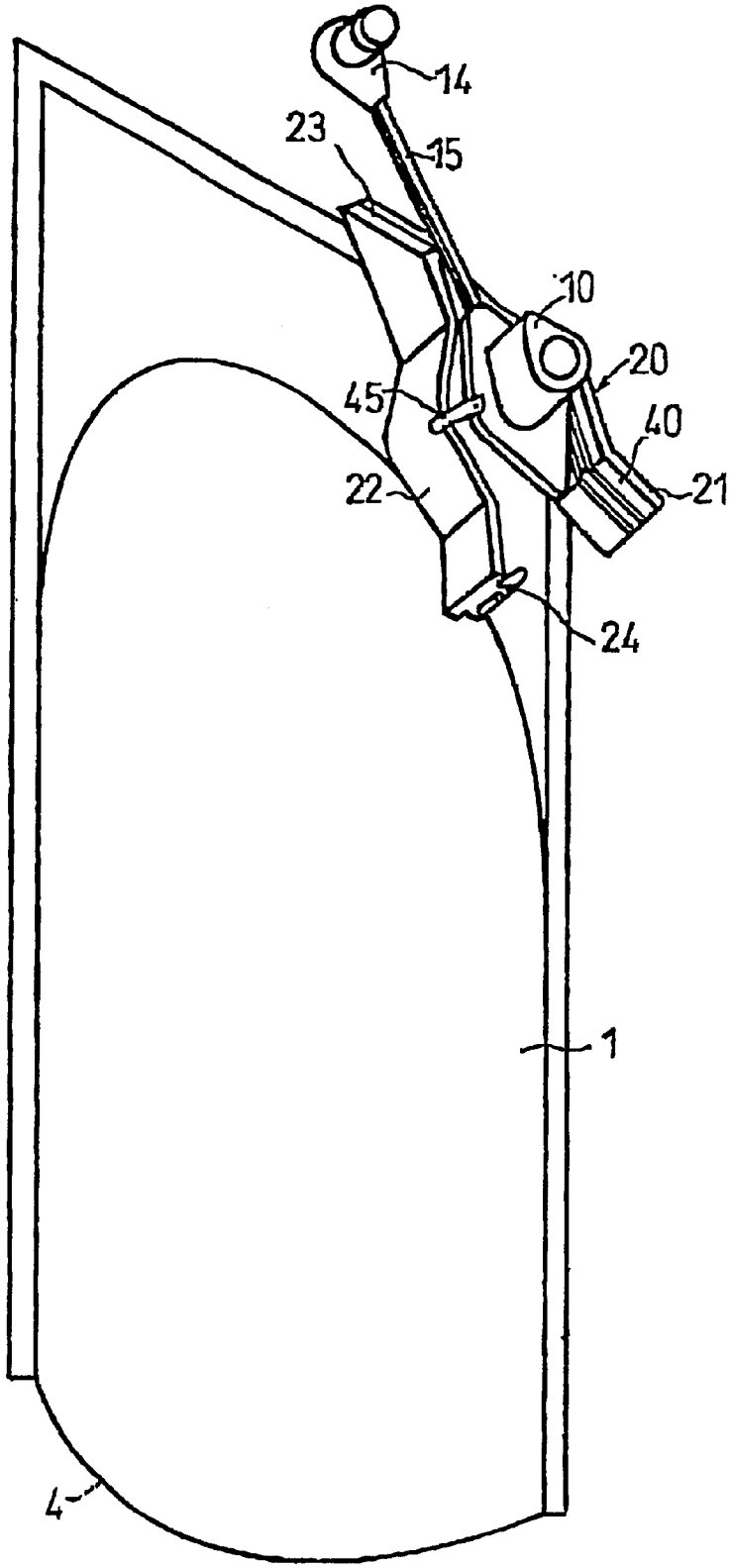
Figure 3:
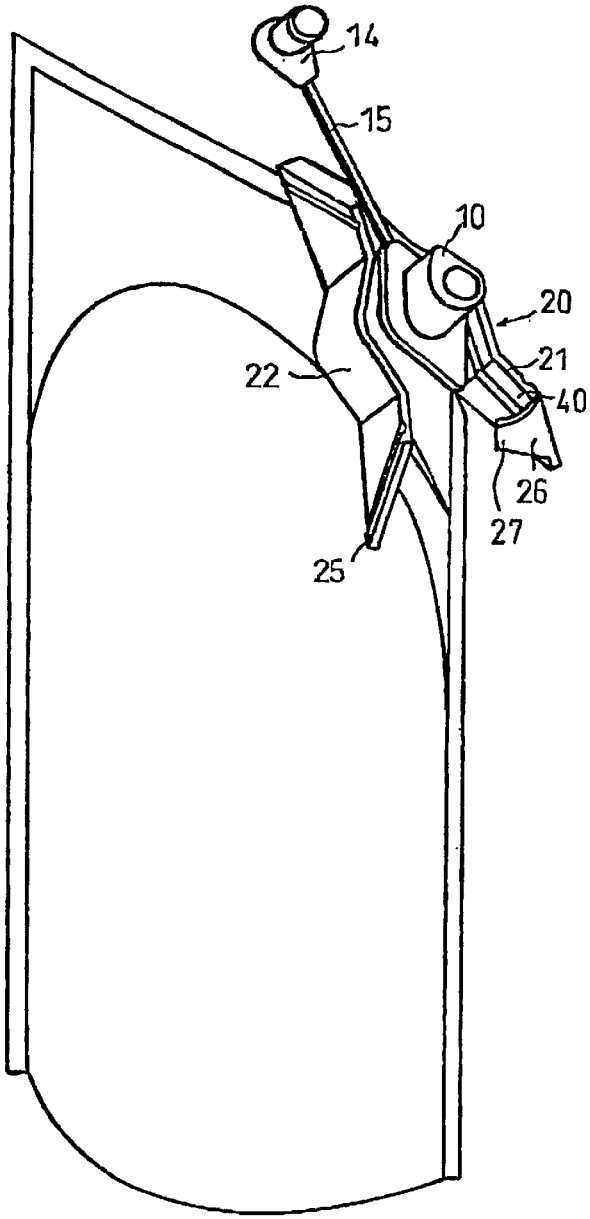
Figure 4:
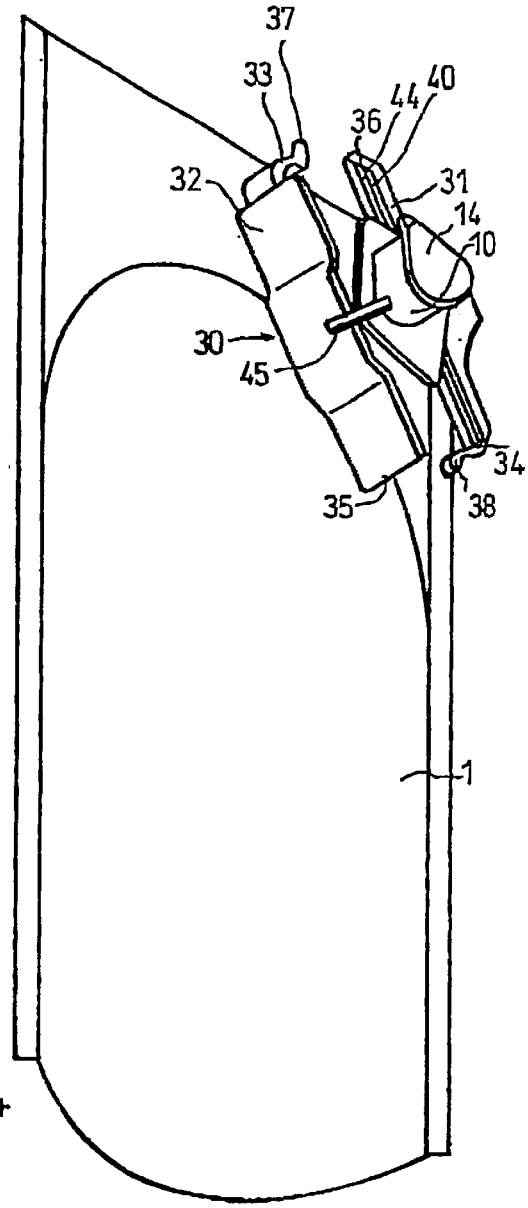
Figure 5:
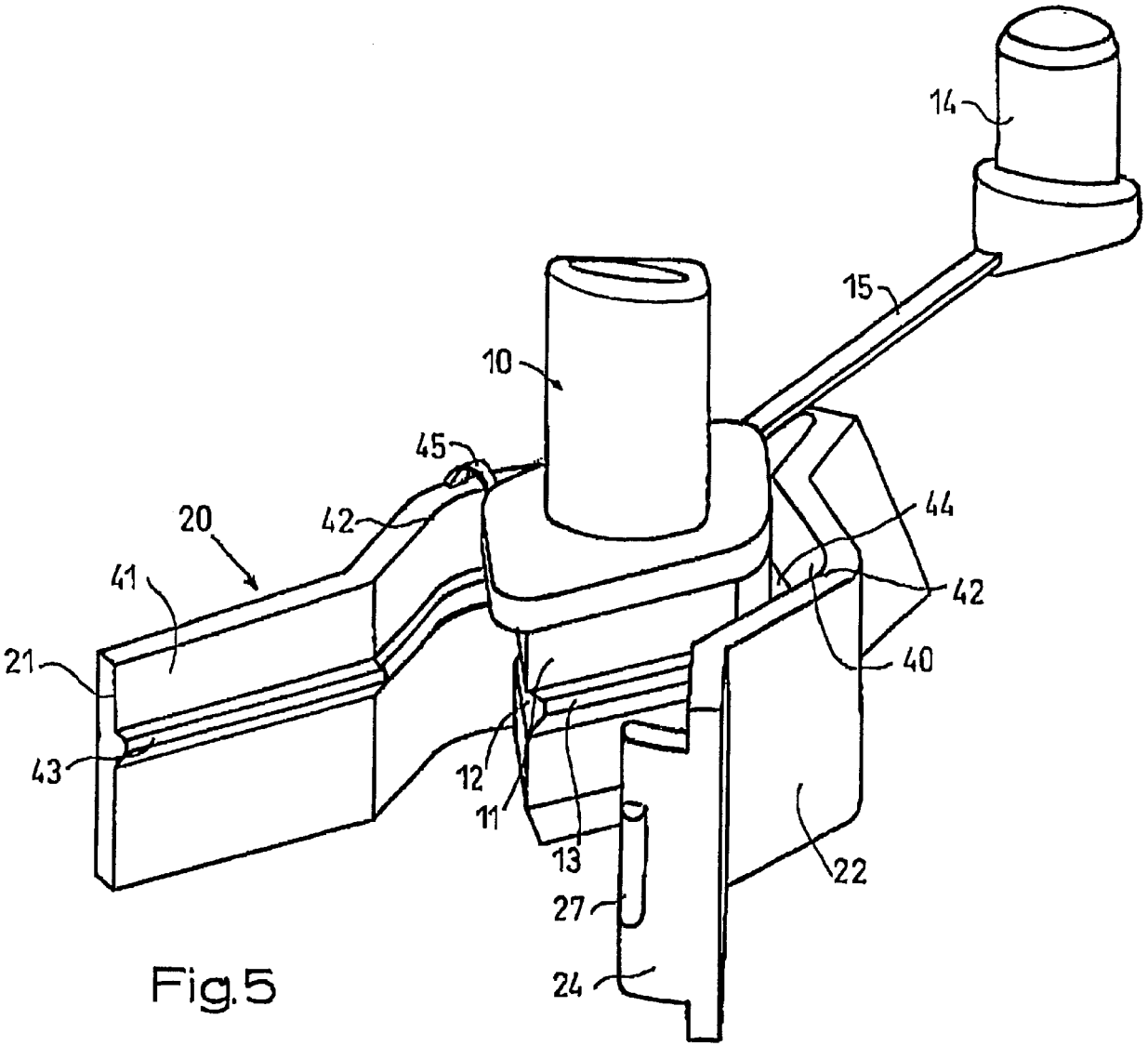
Figure 6:
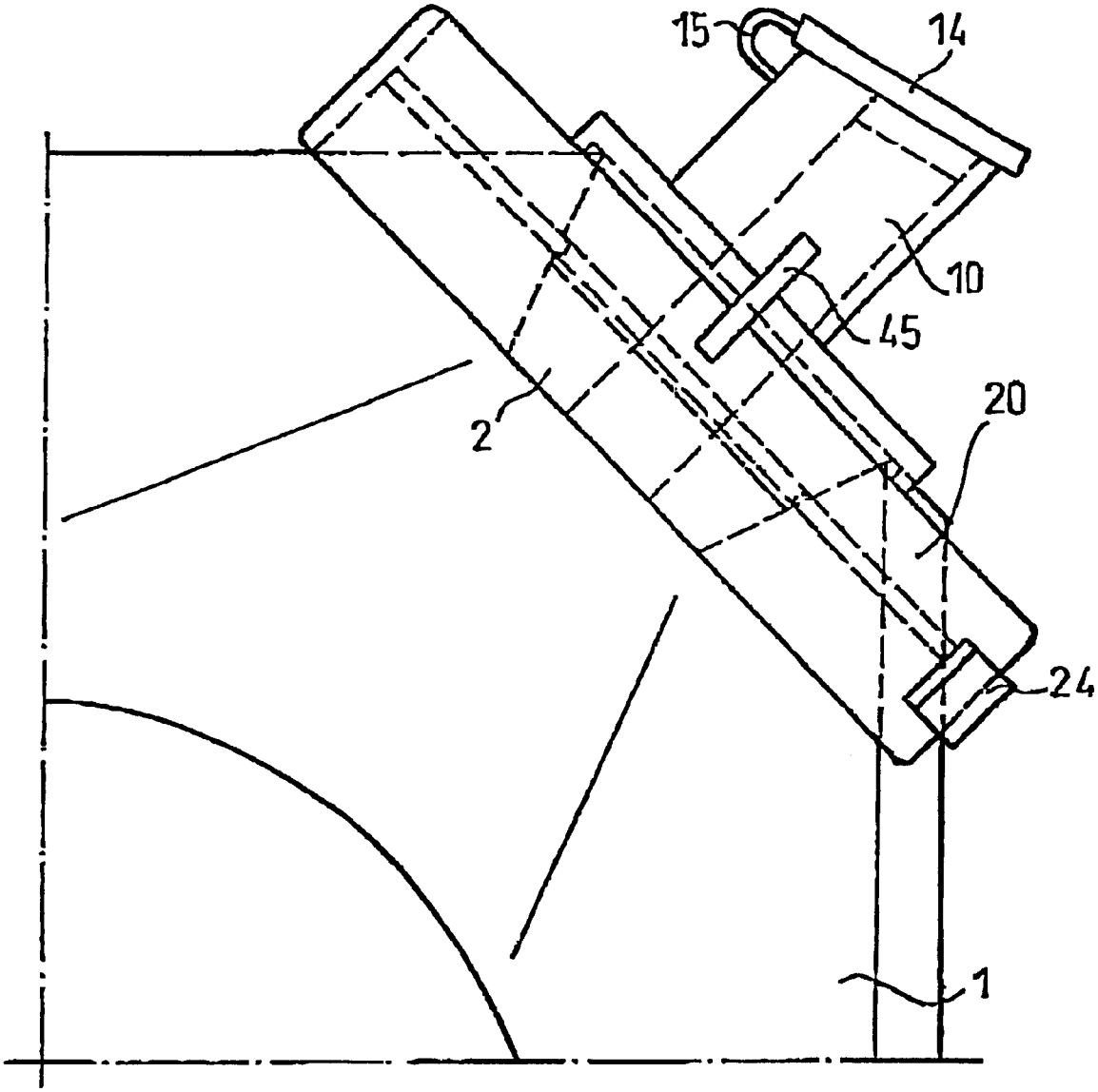

The invention will be explained in greater detail below based on a number of embodiments with reference to the appended drawings, in which:

FIG. 1 shows a perspective view of a standing bag that has been opened by cutting off a bag corner diagonally, FIG. 2 shows a perspective view of the bag from FIG. 1 with a first embodiment of an inventive pouring spout, FIG. 3 shows a perspective view of a bag according to FIG. 1 with a second embodiment of an inventive pouring spout, FIG. 4 shows a perspective view of a bag according to FIG. 1 with a third embodiment of an inventive pouring spout, FIG. 5 shows an enlarged perspective illustration of the pouring spout according to FIG. 2, FIG. 6 shows a detailed side view of the pouring spout according to FIG. 2 and FIG. 5 on a bag corner.

FIG. 1 shows a typical bag (1) used to package, e.g., liquid or powdered laundry detergents, food items, such as soups or sauces, etc. This bag (1) substantially comprises two side walls (3), which are heat sealed all around and which form a base (4) at the bottom, e.g., by means of a suitable folding. Bags (1) of this type can be produced in a simple manner from tubular foil or paper material. The upper front corner has been cut off diagonally for removal of the contents, resulting in the formation of a bag opening (2) in the corner.

The spout (10) of the inventive pouring spout is inserted into this bag opening (2) (see FIG. 2 through 4 and 6.) By means of a clip (20, 30) that encompasses the spout (10) in a collar-band-like manner, the bag wall (3) surrounding the spout (10) is held clamped in relative to the spout (10) such that the bag (1) is tightly sealed against the outside of the spout. Located in the spout (10) is a stopper (14) that is connected to the spout (10) via a thin web (15) and by means of which the spout (10) can be closed so that the bag (1) is altogether tightly closed.

In the embodiment according to FIG. 2, the clip (20) is formed clasp-like with two legs (21, 22). These legs (21, 22) are connected to each other at one end by means of a film hinge (23). The two legs (21, 22) are formed bow-like in such a way that a clamping channel (42) is created on the opposed insides (40, 41). When the legs (21, 22) rest against each other, these clamping channels (42) form an opening extending perpendicular to the longitudinal direction of the legs in which the spout (10) is held in a form-fitting manner (see FIG. 5).

The insides (40, 41) of the legs (21, 22) of the clip (20) and the outside walls (11) of the spout (10) each have grooves (12, 44) and tongues (13, 43), respectively, that cooperate with each other. Especially in the embodiment shown here, one of the legs (22) has a continuous groove (44) and the other leg (21) has a continuous tongue (43), which interlock in the end sections of the legs (21, 22).

In the region of the clamping channel (42), the groove (44) of one leg (22) and the tongue (43) of the other leg (21) engage into a corresponding groove (12) or around a tongue (13) on the two outside walls (11) of the spout (10) extending in the longitudinal direction. It is also possible, of course, for the spout (10) to have an overall circumferential groove or circumferential tongue and for the grooves and tongues of one or the other clip, for example, to have different designs in their end sections and in the region of the clamping channel (42).

At the end opposite the film hinge (23), one of the legs (22) has a snap-in hook (24) that extends around the end edge of the other leg (21) and is held in a snap-in nose or the like (not shown) located on the outside of the end edge. The legs (21, 22) of the clip (20) are cut off diagonally on the hinged side so that the clip (20) conforms to the upper edge of the bag when the spout (10) is inserted into a bag opening that has been created by cutting off a bag comer. At the other end that has the snap-in connection, the legs (21, 22) end perpendicular to the longitudinal direction.

FIG. 3 shows a further embodiment of a clasp-like clip in which the snap in means (25, 26) are designed a little different. Also, the end on the side of the snap-in means is slanted, i.e., adapted to the shape of the bag. A small pull tab (27) by which the snap-in connection can be released, is located on each snap-in hook (24, 26).

FIG. 4 shows an embodiment with a clip (30) in the form of a two-part collar band (30). The two collar band halves (31, 32) each have on one end a snap-in hook (33, 34) with an extended pull tab (37, 38) provided on the same. The opposite end of the respective other half of the collar band (31, 32) has a corresponding snap-in nose (35, 36) behind which the snap-in hook (33, 34) snaps into place. In this embodiment both collar band halves (31, 33) are connected to the spout (10) by means of thin, flexible webs (45).

In the embodiments according to FIG. 3 and FIG. 4, the legs (21, 22) or collar band halves (31, 32) are also each formed bow-like in their center regions so that a clamping channel (42) for the spout (10) is formed. In this case, too, the insides (40, 41) of the legs (21, 22) or collar band halves (31, 32) of the clip (20, 30) and the outside walls (11) of the spout (10) each have cooperating grooves (12, 44) and tongues (13, 43), respectively, that interlock in a form-fitting manner and tightly clamp in the bag walls (3).

The entire pouring spout can be manufactured in a simple and cost-effective manner from plastic, e.g., by injection molding. It can be used with bags of any shape or type, e.g., different types of material, such as paper bags or plastic bags. In particular for use with bags that are not made of plastic it offers the advantage that, in contrast to spouts that are firmly heat-sealed or glued to the bag, the bag can be recycled true to its material after removal of the spout (10).

What is claimed is:

1. A pouring spout for bags (1) comprising a spout (10) inserted into a bag opening (2) and collar-band-like clamping means (20, 30) that detachably hold the spout (10) inside in the bag opening (2) such that it is sealed relative to the bag wall (3), said clamping means (20, 30) being designed as a clip (20, 30), clasp-like with two legs (21, 22) or collar band halves (31, 32) having cooperating snap-in means (24, 25, 26, 35, 36) on their ends, and said legs (21, 22) or collar band halves (31, 32) of the clip (20, 30) having on their opposed insides (40, 41) a clamping channel (42) so that an opening is formed between the joined legs (21, 22) or collar band halves (31, 32), in which the spout (10) is held in a formfitting manner, and said insides (40, 41) of the legs (21, 22) or collar band halves (31, 32) of the clip (20, 30) and the outside wall (11) of the spout (10) each having grooves (12, 44) and/or tongues (13, 43) cooperating with each other, characterized in that the groove (44) and the tongue (43) on the legs (21, 22) of the collar band halves (31, 32) are formed continuous, also in their end sections, forming a groove-and-tongue connection there as well.

2. A pouring spout according to claim 1, characterized in that the legs (21, 22) are connected to each other by means of a hinge (23).

3. A pouring spout according to claim 2, characterized in that the clip (20) with the legs (21, 22), hinge (23), and snap-in means (24, 25, 26) is manufactured as one piece.

4. A pouring spout according to claim 1, characterized in that the collar band halves (31, 32) each have on both ends said snap-in means (33, 34) that cooperate with corresponding snap-in means (35, 36) on the ends of the respective other half of the collar band (31, 32).

5. A pouring spout according to claim 1, characterized in that at least one of the snap-in means (26, 34, 33) has a pull tab (27, 37, 38) for releasing the snap-in connection.

6. A pouring spout according to claim 1, characterized in that the bag opening (2) is formed by a corner of the bag that has been cut off diagonally.

7. A pouring spout according to claim 1, characterized in that the spout (10) and the clip (20, 30) or clip elements (31, 32) are connected to one another by flexible webs (45).

8. A pouring spout according to claim 1, characterized in that the spout (10) has a closing means (14).

* * * * *